US009631414B2

(12) United States Patent
Kamrath et al.

(10) Patent No.: US 9,631,414 B2
(45) Date of Patent: Apr. 25, 2017

(54) DEVICE FOR MANAGING VALUABLES INCLUDING MONEY

(75) Inventors: Sven Kamrath, Linden (DE); Marc Rinderspacher, Hamburg (DE); Marco Zander, Kiel (DE); Tom Brey, Uetersen (DE)

(73) Assignee: Novomatic AG, Gumpoldskirchen (AT)

( * ) Notice: Subject to any disclaimer, the term of this patent is extended or adjusted under 35 U.S.C. 154(b) by 509 days.

(21) Appl. No.: 13/382,961

(22) PCT Filed: Jul. 12, 2010

(86) PCT No.: PCT/EP2010/004229
§ 371 (c)(1),
(2), (4) Date: Jun. 21, 2012

(87) PCT Pub. No.: WO2011/003627
PCT Pub. Date: Jan. 13, 2011

(65) Prior Publication Data

US 2012/0255467 A1 Oct. 11, 2012

(30) Foreign Application Priority Data

Jul. 12, 2010 (DE) ..... 20 2009 009 549 U

(51) Int. Cl.
*E05G 1/00* (2006.01)
*E05G 1/06* (2006.01)
*G07F 19/00* (2006.01)

(52) U.S. Cl.
CPC ..... *E05G 1/06* (2013.01); *E05G 1/00* (2013.01); *G07F 19/20* (2013.01); *G07F 19/205* (2013.01)

(58) Field of Classification Search
CPC .... E05G 1/00; E05G 1/06; E05G 1/08; E05G 5/00
USPC ..... 70/23, 53, 54, 56, 57; 109/23, 53, 54, 109/56, 57
See application file for complete search history.

(56) References Cited

U.S. PATENT DOCUMENTS

| | | | | |
|---|---|---|---|---|
| 4,615,280 | A | 10/1986 | Shoop et al. | |
| 4,884,514 | A | 12/1989 | Shockey et al. | |
| 6,145,737 | A * | 11/2000 | Imai et al. | 232/1 D |
| 6,276,602 | B1 * | 8/2001 | Henderson et al. | 235/379 |
| 6,587,031 | B1 * | 7/2003 | Daugherty et al. | 340/5.31 |
| 7,070,093 | B2 * | 7/2006 | Siemens et al. | 235/379 |
| 7,516,832 | B2 * | 4/2009 | Dobbins | 109/53 |
| 8,109,379 | B2 * | 2/2012 | Sjostrom | 194/215 |
| 8,939,358 | B2 | 1/2015 | Cardinal et al. | |
| 2002/0020736 | A1 | 2/2002 | Minaishin et al. | |
| 2004/0226493 | A1 * | 11/2004 | Siemens et al. | 109/53 |
| 2005/0040005 | A1 | 2/2005 | Dobbins | |
| 2005/0077347 | A1 * | 4/2005 | Uematsu et al. | 235/379 |

(Continued)

FOREIGN PATENT DOCUMENTS

| | | |
|---|---|---|
| DE | 08803573 U1 | 6/1988 |
| DE | 29801306 U1 | 5/1998 |

*Primary Examiner* — Christopher Boswell
(74) *Attorney, Agent, or Firm* — Kevin H. Fortin

(57) ABSTRACT

A device for managing valuables includes a housing having a service area including a printer, a primary vault attached to the housing and having a primary vault locking system for storing valuables, and a secondary vault mounted in the housing and having control electronics for operating the device. The secondary vault isolates the control electronics from the primary vault and from the service area to inhibit tampering with the control electronics.

14 Claims, 2 Drawing Sheets

(56) References Cited

U.S. PATENT DOCUMENTS

| | | | | |
|---|---|---|---|---|
| 2005/0264409 | A1 | 12/2005 | Monnier | |
| 2008/0082207 | A1 | 4/2008 | Sjostrom | |
| 2013/0048715 | A1* | 2/2013 | Cardinal et al. | 235/379 |

* cited by examiner

DEVICE FOR MANAGING VALUABLES INCLUDING MONEY

CROSS-REFERENCE TO RELATED APPLICATIONS

This application claims priority under 35 U.S.C. 119(a) and 365(b) to International Patent Application No. PCT/EP2010/004229, having an international filing date of 12 Jul. 2010.

FIELD OF THE INVENTION

The invention relates to machines have a locked service area a separately locked vault for management, collection and dispensing of valuables, in particular money.

BACKGROUND AND SUMMARY OF THE INVENTION

A cash machine is a device for managing cash and include automated teller machines (ATMs), money deposit machines, and cash recycling machines. Cash machines are also called bank machines. Valuables include coupons, travel tickets, event tickets, and vouchers having a cash value.

Cash machines enable the customer to withdraw cash from or deposit it to his checking or credit card account through self-service. Some machines also dispense foreign currencies or inform the customer about the account balance and past transactions. Financial institutions often operate such devices.

To withdraw money from a cash machine, a customer inserts a debit or credit card into the machine and enters a personal identification number (PIN). A central authorization office checks online to determine whether or not the personal identification number is correct and decides whether the payout can be made. Newer-generation cash machines also enable cash deposit. This procedure resembles that for depositing: The customer inserts the customer card into the machine. A cash-insertion slot then opens. The money is immediately checked for authenticity and booked to the customer's account. This way, the bank can also provide the money depositing service to its customers outside the office hours and the bank saves itself the enormous personnel expenses of operating a night depository. If the cash machine can recycle, verified money deposited by the customer can be paid out to subsequent customers whereby the bank decreases the labour of filling the machine.

Some cash machines feature a certified vault. A certified vault is one certified secure under any of a number of vault standards, such as CEN3 of the BSEN 12320 European Security standard. Money is housed in the certified vault.

Cash machines also have a service area in which the device's other components are housed. This service area is also termed an operator area. These machines are typically equipped with a receipt printer for receipts or also a bank-statement printer. Here a printer, that creates the receipt or the statement then outputs it to the customer, is installed in the cash machine.

Furthermore, a computer or computer is usually also provided in the device to operate the device.

Servicing is required during the product cycle for a cash machine's various elements, such as the printer or the computer. For example, this can be the refilling of printer paper, software updates, or replacement and repair of mechanical and electrical elements.

With the devices mentioned, the servicing procedure for the printer is usually arranged so that servicing requires opening the device. But by opening the device, it is possible that the servicing staff may have unauthorized access to money supplies or other machine internals or is able to reconnoitre them. Valuables as well as the vault's control units such as the hopper or bank-note collection and/or dispensing mechanism and their electrical leads essentially be arranged completely in the vault, preferably in a certified vault, while essentially all control electronics such as the computer, printer, and power supply is arranged in the service area. Advantageously, the vault and the service area feature separate locking systems.

Accordingly, the certified vault housing must still be opened, if the money- or value-containing or guiding parts arranged in this area need to be serviced. Various service personnel can then provide this. Ordinary service personnel can be employed for the more common and less security-related maintenance and service work in the service area, while for the less commonly arising maintenance and service work in the certified vault, other, possibly specially trained and trusted personnel, can be employed.

For instance, the documents US 2002/0020736 A1, U.S. Pat. No. 4,615,280 and U.S. Pat. No. 4,884,514 show machines for managing, collecting, and/or dispensing valuables. The service area will be opened especially often in this connection to service the account-statement and/or the receipt printer. Often, the relevant paper supplies, for instance bank statement forms or receipt paper rolls, will be replaced or supplemented. Likewise, ink or toner cartridges on the printers are regularly replaced. Due to the frequency of access caused by this, unmonitored personnel often obtain entry, or proper maintenance work is really no longer carefully monitored.

The controller arranged in the service area is vulnerable to manipulation. On the one hand there is the risk that the vault's control units will be manipulated during service work through access to the control electronics in the control and service area. More dangerous, because scarcely subject to service-work monitoring, is, however, manipulation of the control electronics so that, for instance, by installing software, the card readers can be manipulated in a way that unauthorized debit or credit cards are accepted with likewise unverified PIN numbers, so that at a certain time after the actual service work, withdrawals can be made by simply inserting the unauthorized debit or credit card.

DETAILED SUMMARY OF THE INVENTION

The present invention isolates valuables and control electronics separately from each other to prevent access to valuables by those having access to the control electronics, and to prevent access to the service electronics by those with access to the valuables. The present invention houses primary and secondary vaults that are separate and secure from the service area.

According to one aspect of the invention, primary and secondary vaults are provided to isolate the control electronics from the valuables. Particularly, the control electronics for controlling the control units are housed in the primary vault. The secondary vault is separated both from the primary vault for collecting the valuables and from the service area, and exhibits a locking system separate from that of the primary vault and the service area.

By securing the control electronics for the value-processing control elements in a separate, second safe area that is separately lockable, control-electronics manipulation during routine maintenance in the remaining service area is inhibited.

In particular, at least one printer, and paper supplies for printing bank statements and/or receipts, is arranged in the service area so that when replacing the cartridges and filling up the paper supplies, access to the control electronics is not likely. Access to the control electronics is possible only selectively, and if necessary under proper supervision, by opening the primary vault. At the same time, it is ensured here that the secondary vault containing the valuables will be inaccessible, during access to the primary vault. Conversely, access to the control electronics is inhibited during access to the secondary vault containing valuables.

The secondary vault can be integrated into the service area or can form a part of it; however strictly separated from the remaining part of said service area and secured by a separate locking system. The secondary vault can form an area within the service area. For instance, the entire service area can be locked by a service door behind which a part of the service area, and the secondary vault's door, are arranged so that the secondary vault's door can only be opened after the service area's door has been opened. Alternatively, or additionally, however, the secondary vault can also exhibit a separately accessible vault door, i.e. a vault door independent of the service area's locking system and/or independent of whether or not the service area's door is open. According to one elaboration of the invention, the secondary vault can exhibit a vault door that is to be opened from another side of the device than the service area's door. In particular, the secondary vault's and the service area's doors can be opened from opposite sides. The said secondary vault's vault door can, for instance, be designed in the form of a hatch that renders the secondary vault accessible from a front side of the device.

To prevent "tapping into" the controller via the connection cable or direct manipulation of the primary vault's control units, advantageously no freely-accessible connection cables between the control electronics in the secondary vault and the primary vault's control units from the service area are provided to the service area in a further elaboration of the invention. In accordance with an advantageous embodiment of the invention, wireless communication between the control electronics in the secondary vault and the control units in the primary vault may be provided for this, where advantageously the control electronics in the secondary vault and the control units in the primary vault can each exhibit a wireless transmitting and/or receiving device.

However, in an embodiment of the invention, interconnection lines preferably in the form of a wire harness are provided between the control electronics in the secondary vault and the control units in the primary vault, wherein one or more connecting lines are advantageously completely accommodated in the first and secondary vaults. Advantageously, the first and secondary vaults are arranged adjacent to and/or bordering each other for this and are only divided from each other by the vault-area wall so that the connecting line is guided through a opening in the vault-area walls or through a vault-area wall common to the two vaults. Alternatively, or additionally, the connection lines between the two vaults can also be separated from the rest of the service area by a secure line casing made of a high-strength, tamper-proof material, for instance guided through a cable conduit made of high-strength, manipulation-proof material that connects the first and secondary vaults to one another.

In a further elaboration of the invention, the connecting line or lines between the control electronics in the secondary vault and the control units of the primary vault are here provided with a detachable connection interface, for example in the form of a contact plug, which is preferably arranged in the area between the primary vault and the secondary vault. Appropriate maintenance or repair work can be conducted on the connecting lines via such a detachable interface without requiring simultaneous access to both of the vaults. For instance, if a damaged cable in the secondary vault needs to be replaced, this can be done by detaching the interface and reattaching it after the cable replacement without having to open the primary vault to do it.

The control electronics' computer is advantageously housed in the said secondary vault, which actuates the vault's control units such as the hopper and/or the bank note collection/dispensing mechanism, and controls additional electronic device components like the printer, screen, card-reader device, PIN-query units, and the like arranged in the service area.

It has proven especially advantageous in devices of the said type when all of the elements in the service area not housed in the first and/or secondary vaults are arranged as closely to one another as possible. Such a design leads to the least possible space requirement.

Furthermore, it has also proven advantageous when the service area and/or the secondary vault are separable from the primary vault.

In such an embodiment, it is then possible for the service area to be fully interchangeable, if necessary, or for more complex maintenance tasks to be conducted in a different place while the significantly larger and heavier vault can remain on site. The primary vault can also be advantageously separated from the secondary vault to enable only the secondary vault having to be removed during complicated maintenance work on the control electronics. The previously mentioned connection line's detachable interface is advantageous for this. Alternatively, or additionally, it can also be provided that the control electronics is detachably accommodated in the secondary vault.

According to a further preferred embodiment of the present invention, essentially all of the control electronics such as the computer and the power supply is arranged in the secondary vault, with the exception of the printer. The printer and its paper supply are arranged in the service area outside of the secondary vault.

It is particularly advantageous when components with a higher maintenance frequency are arranged to be more easily accessible than components with lower maintenance frequency. So, for example, the relatively service-intensive printer can be arranged for easy accessibility, while components which normally rarely need maintenance or service, such as the power supply, can be arranged a little less accessibly. When, for instance, access to the service area occurs from behind, then the printer could be arranged there right in front while the less often required components can be arranged farther toward the front of the device.

According to a further preferred embodiment of the present invention, the first and secondary vaults, and the service area form a unit in the device's service-ready state.

The described device can, for instance, be designed as a cash machine, pay machine, and/or vending machine.

BRIEF DESCRIPTION OF THE DRAWINGS

The drawings illustrate examples of the invention.

DETAILED DESCRIPTION

Figure 1:
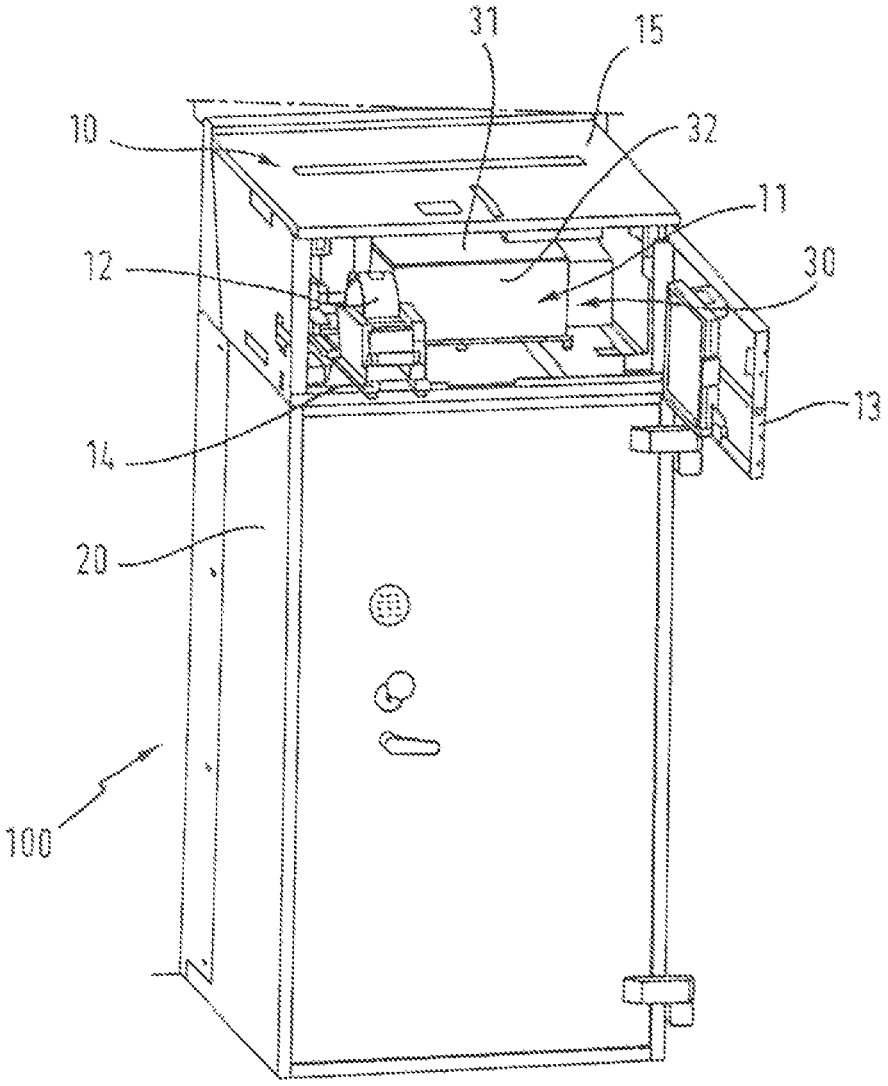
FIG. 1 is a perspective view of a device according to a preferred embodiment of the invention having a primary vault and a secondary vault located above the primary vault.

FIG. 1 shows a perspective view of a device 100. The device 100 is shown from a back side. The device 100 manages valuables including money. Managing valuables includes collecting, dispensing and receiving valuables, particularly money. The device 100 has a service area 10 and a primary vault 20. The service area 10 has a housing 15. The housing is constructed as a vault according to the preferred embodiment shown. The service area 10 has a door 13, which opens, as shown. The vault 20 is preferably a certified vault for storing valuables. The primary vault 20 also has a door, which opens, closes and locks. The primary vault 20 and the service area 10 are separately accessible.

The device 100 has a primary vault 20 arranged beneath the service area 10. The primary vault 20 is preferably a certified vault for storing valuables, such as money, tickets, vouchers, coupons and the like.

The device 100 has control units in the service area 10. The control units include a computer 11, a printer 12, receipt paper, and a power supply 16.

The control units may include a hopper for receiving valuables, such money. The vault 20 includes a bank-note magazine device and/or a bank-note collection and/or dispensing unit for receiving valuables from the controlling unit.

According to the preferred embodiment of the invention shown, the service area 10, can be opened for maintenance and service work via the door 13. The printer 12 slidably mounts rails 14 aligned with respect to the door 13 of the service area 10. The rails 14 enable the printer to be pulled out of the device 100 for maintenance and service. Other less frequently serviced components can be mounted further from the door 13.

The control units, including the computer, 11, and possibly also its power supply, 16, are advantageously arranged inside of the said service area, 10, in a secondary vault, 30, which is arranged completely inside of the service area, 10, in the design shown and is only accessible by opening the door, 13, of the service area, 10.

The said secondary vault, 30, can likewise be constructed as a certified vault. In any case, it possesses a high-strength vault housing, 31, the wall of which is constructed to be manipulation-proof and consists of high-strength material of sufficient wall thickness. The secondary vault 30 possesses considerably greater wall- and break-in-security than the housing 15 of the service area 10.

The said secondary vault, 30, possesses a separate locking system, which locks the secondary vault, 30, independently of the primary vault, 20, and separately from the service area, 10. In particular, the vault housing, 31, possesses a vault door, 32, which is accessible after opening the door, 13, of the service area, 10, but is only to be opened separately or remains locked during access only to the printer, 12. Instead of the arrangement shown in FIG. 1, the said vault door, 32, can also be arranged on a side opposite the door, 13, of the service area, 10, and opened from there, i.e. the vault door, 32, can in particular also be opened from a front side of the device. Accessibility from opposite sides enables maintenance on the control electronics from a separate room, i.e. the service technician need not enter the space in which the bank's employees conduct corresponding service work. In particular, the said vault door, 32, can also be arranged on a side opposite the door of the primary vault, 20. Arrangement of the doors on opposite sides is particularly advantageous when the device is integrated into a building wall or masonry wall so that the door arrangement on opposite sides enables accessibility from various building rooms.

Figure 2:
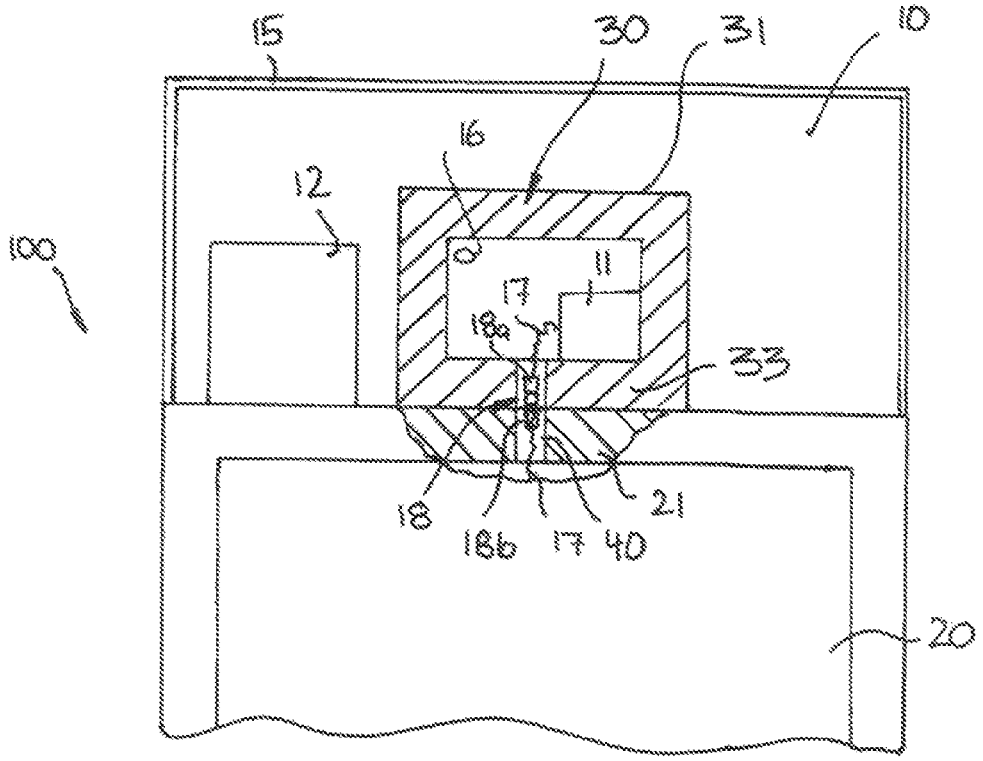
FIG. 2 is a front view having a cut-away portion showing the primary vault that encloses valuables, and a secondary vault for enclosing electronics.

The secondary vault 30, and the primary vault 20 sit advantageously immediately on top of one another so that corresponding vault walls 21 and 33 border one another, see FIG. 2.

The computer 11 is situated of the secondary vault 30 and contains control electronics, which actuates the money-guiding or processing units of the primary vault, 20. For this, the computer, 11, is connected by a connecting line, 17, to the control units of the primary vault, 20, wherein said connecting line 17, is guided through an opening 40, which passes through the walls of the two vaults, 20 and 30, and connects the two vaults 20 and 30 with one another. The opening 40 is constructed to be as small as possible so that it offers no possibility of manipulating one of the vaults from the other.

FIG. 2 shows the connecting line 17 extends from the computer 11 to the primary vault 20 via the opening 40. The connecting line 17 has a detachable interface 18 in the area of the opening 40. The detachable interface 18 enables the connection line 17 to be maintained or replaced during access to the secondary vault 30, without requiring access to the primary vault 20.

The interface 18, is advantageously constructed and/or arranged here in such a way that during work on the line interface in one of the vaults, no access to the cable section in the other vault is necessary and/or possible. In particular, the said interface, 18, can encompass two coupling parts, 18*a* and 18*b*, which are detachably connectable to one another. Each is arranged counter sunk in the opening 40, and held in place with a mounting so that detaching or connecting one coupling part requires no manipulation or handling of the other coupling part. For instance, the coupling parts 18*a* and 18*b*, can each be fastened countersunk in the opening 40, by a snap connection so that, for instance, the part of the line in the upper vault can be pulled out or inserted in from above without having to hold the lower part of the line in the lower vault.

The mounting for the coupling parts 18*a* and 18*b*, can be advantageously constructed here in such a way that detaching the respective coupling part, 18*a* or 18*b*, is only possible on the side from which line piece fastened to the respective coupling part, 18*a* or 18*b* exits. According to FIG. 2, the upper coupling part 18*a*, can only be detached from above, while the lower coupling part 18*b*, can only be detached from below. For instance, this can be achieved by appropriately arranged snap tabs or the like, which are only accessible from one side.

According to the embodiment shown, money or valuables are housed inside of the primary vault 20. The service area 10, the secondary vault 30, and the primary vault, 20 are physically separated in a secure manner.

Both the primary vault 20 and the secondary vault 30 can be separated and replaced singly or mutually, or together with the service area 10, by detaching connections. For instance, this can be made possible by a threaded and/or a screw connection, for example in the form of a screw bolt in vault 20 and/or in vault 30.

Moreover the primary vault 20, the secondary vault 30 and the service area 10 each have distinct locking systems.

The device 100, shown in the figures can be constructed as a free-standing, column-like device. In elaboration of the invention, however, it can also be constructed as a built-in device that, for instance, can be built into a building wall so that essentially only the back side and the front side lying opposite shown in FIG. 1 are accessible from different sides of the wall.

We claim:

1. A device for managing valuables comprising:

a housing having a service area including a printer;

a primary vault attached to the housing and having a primary vault locking system for storing valuables;

a secondary vault mounted on the primary vault and having control electronics for operating the device, the secondary vault isolates the control electronics from the primary vault and from the service area;

the secondary vault sits immediately on top of the primary vault, the primary and secondary vaults define an opening to enable a connecting line to extend through the opening, the opening is sized small enough to inhibit access between vaults;

the connecting line includes a detachable interface in the opening including a contact plug with a first coupling part and a second coupling part situated above and below each other in the opening;

the first coupling pail and the second coupling part being countersunk within the opening with a snap-fit connection so that detaching or connecting the first coupling part can be accomplished without manipulating the other coupling part, and wherein both the primary vault and secondary vault include control electronics that electrically connect through the connecting line.

2. A device according to claim 1, wherein the secondary vault is arranged inside of the service area.

3. A device as set forth in claim 1, wherein the device has a service area door, a primary vault door and a secondary vault door, each of which, has a separate locking system.

4. A device as set forth in claim 3, wherein the secondary vault is enclosed by the service area door so that access to the secondary vault is only achievable when the service area door is open.

5. A device as set forth in claim 1, wherein the housing includes sliding tracks, the printer mounts on the sliding tracks to enable service and maintenance of the printer.

6. A device for managing valuables comprising:

a housing having a service area including a printer;

a primary vault attached to the housing and having a primary vault locking system for storing valuables;

a control unit in the primary vault;

a secondary vault mounted on the primary vault and having control electronics including a computer and a power supply for operating the device, the secondary vault isolates the control electronics from the primary vault and from the service area;

the secondary vault sits immediately on top of the primary vault defining an opening that extends between the secondary vault and the primary vault; and a connecting line having a detachable interface, including a first coupling part and a second coupling part countersunk in snap-fit connection in the opening between the primary vault and the secondary vault for enabling a detachable electrical connection between the control unit and the control electronics, whereby, pulling the first coupling part from within the primary vault detaches the connecting line without any need for accessing the secondary vault or handling the second coupling part.

7. A device according to claim 6, wherein the secondary vault is arranged inside of the service area.

8. A device as set forth in claim 7, wherein the detachable interface is countersunk in the secondary vault to inhibit tampering.

9. A device as set forth in claim 8, wherein the detachable interface is countersunk in the primary vault to inhibit tampering.

10. A device as set forth in claim 6, wherein the device has a service area door, a primary vault door and a secondary vault door, each of which has a separate locking system.

11. A device as set forth in claim 10, wherein the secondary vault is enclosed by the service area so that access to the secondary vault is only achievable when the service area door is open.

12. A device as set forth in claim 11, wherein the housing includes sliding tracks, the printer mounts on the sliding tracks to enable service and maintenance of the printer.

13. A device capable of managing valuables comprising:

a housing having a service area including a printer;

a primary vault attached to the housing and having a primary vault locking system for storing valuables;

a secondary vault, the secondary vault sits immediately on top of the primary vault defining an opening that extends between the secondary vault and the primary vault;

control electronics being mounted in the secondary vault, the control electronics including a computer and a power supply for operating the device;

a connecting line extending between the control electronics of the secondary vault into the primary vault, the connecting line including a detachable interface in the opening between the primary vault and the secondary vault;

the detachable interface includes a first coupling part and a second coupling part countersunk in a snap-fit in the opening, and wherein, pulling the second coupling part from within the secondary vault detaches the connecting line without any need to access the primary vault or to handle the first coupling part.

14. A device as set forth in claim 13, wherein the detachable interface includes a contact plug within the opening and the first coupling part is counter sunk in the primary vault and a second coupling part is countersunk in the secondary vault.

* * * * *